US008816921B2

(12) United States Patent
Ayatollahi

(10) Patent No.: US 8,816,921 B2
(45) Date of Patent: Aug. 26, 2014

(54) MULTIPLE ANTENNA ASSEMBLY UTILIZING ELECTRO BAND GAP ISOLATION STRUCTURES

(75) Inventor: Mina Ayatollahi, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 632 days.

(21) Appl. No.: 13/095,256

(22) Filed: Apr. 27, 2011

(65) Prior Publication Data

US 2012/0274522 A1 Nov. 1, 2012

(51) Int. Cl.

| | |
|---|---|
| ***H01Q 19/10*** | (2006.01) |
| ***H01Q 1/52*** | (2006.01) |
| ***H01Q 17/00*** | (2006.01) |
| ***H01Q 13/10*** | (2006.01) |
| ***H01Q 1/24*** | (2006.01) |

(52) U.S. Cl.

CPC ..... *H01Q 1/521* (2013.01); *H01Q 17/00* (2013.01); *H01Q 13/10* (2013.01); *H01Q 17/007* (2013.01); *H01Q 1/243* (2013.01)

USPC ..... 343/745; 343/702; 343/601

(58) Field of Classification Search

USPC ..... 343/745, 702, 601

See application file for complete search history.

(56) References Cited

U.S. PATENT DOCUMENTS

| | | | |
|---|---|---|---|
| 7,042,419 | B2 | 5/2006 | Werner et al. |
| 7,215,301 | B2 | 5/2007 | Choi et al. |
| 7,352,328 | B2 | 4/2008 | Moon et al. |
| 7,586,444 | B2 | 9/2009 | Berlin et al. |
| 7,760,140 | B2 | 7/2010 | Kamgaing |
| 7,764,149 | B2 | 7/2010 | Han et al. |
| 7,773,033 | B2 | 8/2010 | Morton et al. |
| 2006/0125713 | A1 | 6/2006 | Thevenot et al. |
| 2009/0160715 | A1 * | 6/2009 | Man et al. ..... 343/702 |

FOREIGN PATENT DOCUMENTS

| | | |
|---|---|---|
| GB | 2360132 | 9/2001 |

OTHER PUBLICATIONS

Bait-Suwailam, et al.; Mutual Coupling Reduction Between Microstrip Patch Antennas Using Slotted-Complementary Split-Ring Resonators; IEEE Antennas and Wireless Propagation Letters; vol. 8; Jan. 1, 2010; pp. 876-878.

Lihao, et al.; Reduction of mutual coupling between closely-packed antenna elements with split ring resonator (SSR); 2010 International Conference on Microwave and Millimeter Wave Technology; May 8, 2010; pp. 1873-1875.

Gil; Varactor-loaded split ring resonators for tunable notch filters at microwave frequencies; Electronics Letters; vol. 40; No. 21; Oct. 14, 2004; pp. 1347-1348.

(Continued)

*Primary Examiner* — Allyson Trail

(74) *Attorney, Agent, or Firm* — Quarles & Brady LLP

(57) ABSTRACT

A multiple antenna assembly with high isolation between the antennas is disclosed. The assembly includes a dielectric substrate with a ground plane and first and second antennas thereon. One or more metal-dielectric isolation structures are on the substrate at locations at which an electric current is present that has a current density greater than a predefined threshold. Each metal-dielectric isolation structure resonates at a given frequency that inhibits mutual signal coupling between the first and second antennas. Various configurations, such as concentric ring patterns, for the metal-dielectric isolation structures are disclosed. A device can be provided to dynamically tune the given frequency of the metal-dielectric isolation structures to correspond to radio frequency signals emitted by the first and second antennas.

24 Claims, 3 Drawing Sheets

(56) References Cited

OTHER PUBLICATIONS

Ucar, et al.; Switchable Split-Ring Frequency Selective Surfaces; Progress in Electromagnetics Research B; vol. 6; 2008; pp. 65-79.
Gregorwich; The design and development of frequency selective surfaces for phased arrays; Aerospace Conference; vol. 5, Mar. 6-13, 1999; pp. 471-479.
Liang; Microstrip Patch Antennas on Tunable Electromagnetic Band-gap Substrates; IEEE Transactions on Antennas and Propagation; vol. 57; No. 6; Jun. 2009; pp. 1612-1617.
B. Sanz-Izquierdo, et al., Dual-Band Tunable Screen Using Complementary Split Ring Resonators, IEEE Transactions on Antennas and Propagation, Nov. 2010, vol. 58, No. 11, pp. 3761-3765.
S. S. Karthikeyan, et al., Reduction of specific absorption rate in human tissues using split ring resonators, Indian Institute of Technology Guwahat, Assam, India, IEEE 2009.
Jiunn-Nan Hwang, et al., Reduction of the Peak SAR in the Human Head With Metamaterials, IEEE Transactions on Antennas and Propagation, Dec. 2006, vol. 54, No. 12, pp. 3763-3770.
Sang Il Kwak, et al., Design of Multilayer PIFA based on an EBG structure for SAR reduction in mobile Applications, IEEE 2009, pp. 645-648.
Sun, et al., "Electromagnetic Bandgap Enhancement Using the High-Impedance Property of Offset Finite-Ground Microstrip Line," Microwave and Optical Technology Letters, Vo. 47, No. 6, pp. 543-546, Dec. 20, 2005.
Chou, et al., "Investigations of Isolation Improvement Techniques for Multiple Input Multiple Output (MIMO) WLAN Portable Terminal Applications," Progress in Electromagnetics Research, PIER 85, pp. 349-366, 2008.

* cited by examiner

MULTIPLE ANTENNA ASSEMBLY UTILIZING ELECTRO BAND GAP ISOLATION STRUCTURES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

The present disclosure relates generally to antennas for portable, handheld communication devices, and more particularly to assemblies of multiple antennas for such devices.

Different types of wireless mobile communication devices, such as personal digital assistants, cellular telephones, and wireless two-way email communication equipment, cellular smart-phones, wirelessly enabled notebook computers, are available. Many of these devices are intended to be easily carried on the person of a user, often compact enough to fit in a shirt or coat pocket.

As the use of wireless communication equipment continues to increase dramatically, a need exists for increased system capacity. One technique for improving the capacity is to provide uncorrelated propagation paths using Multiple Input, Multiple Output (MIMO) systems. A MIMO system employs a number of separate independent signal paths, for example by means of several transmitting and receiving antennas.

MIMO systems, employing multiple antennas at both the transmitter and receiver offer increased capacity and enhanced performance for communication systems without the need for increased transmission power or bandwidth. The limited space in the enclosure of the mobile communication device, however presents several challenges when designing such multiple antennas assemblies. An antenna should be compact to occupy minimal space and its location is critical to minimize performance degradation due to electromagnetic interference. Bandwidth is another consideration that the antenna designers face in multiple antenna systems.

Furthermore, since the multiple antennas are located close to each other, strong mutual coupling occurs between their elements, which distorts the radiation patterns of each antenna and degrades system performance, often causing an antenna element to radiate an unwanted signal. Thus, minimal coupling between antennas in MIMO antenna arrays is preferred to increase system efficiency and battery life, and improve received signal quality.

Previously electromagnetic band gap (EBG) structures have been used for various isolation purposes. EBG structures are periodic arrays of objects or cells that prevent the propagation of the electromagnetic waves in a specified band of frequencies. These arrays were either linear, in which a plurality of EBG cells were spaced at equal distances along a line, or two-dimensional, in which a plurality of EBG cells were spaced at equal distances in both of two orthogonal dimensions. In a common configuration where two antennas are located on a surface of a printed circuit board, a line of periodically spaced EBG cells extend between those antennas from one edge of the printed circuit board to and opposite edge. This forms a continuous signal barrier between the antennas. Both linear and two-dimensional arrays of EBG cells used a shotgun approach by forming a barrier along a relatively large section so that wherever a signal from an antenna may travel through that section one of more cells would block the path of the signal. Such an unfocussed shotgun approach affected the ground plane by the placement of significantly more EBG cells than were actually required for isolating signal emitted by an antenna from reaching another device.

In addition MIMO antenna arrays often are capable of being tuned to operate at several different radio frequency bands and their operating frequency and parameters can be changed based on system requirements. Conventional EBG cells on the other hand, are designed to operate at a single stop band of frequencies. Therefore such EBG cells provided less than optimal isolation when the antennas are tuned and operating at a different frequency band than the stop band of EBG cells.

Therefore, it is desirable to develop a MIMO antenna arrangement which has a compact size to fit within a communication device housing and has a high level of isolation between the antennas for optimal performance across all frequency bands of operation.

DETAILED DESCRIPTION

Figure 1:
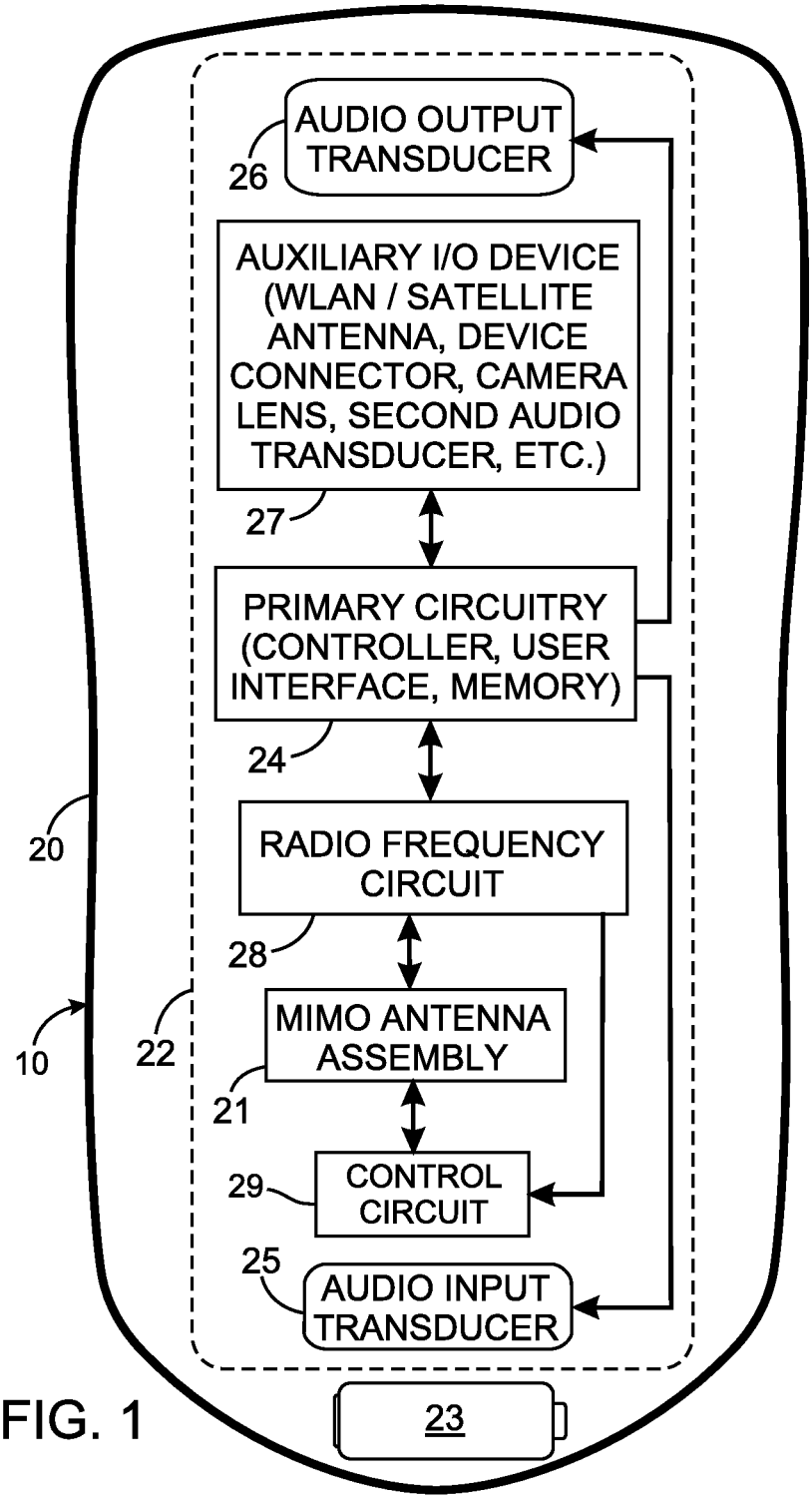
FIG. 1 is a schematic block diagram of a mobile, wireless communication device that incorporates the present antenna assembly.

The present antenna array for communication devices provides isolation between the separate antennas in a wide bandwidth, for example covering 2.25-5.00 GHZ and supporting multiple communication standards. Nevertheless, the techniques described herein can be used to design isolating structures in other frequency ranges. The exemplary antenna assembly has two identical radiating elements or antennas, which in the illustrated embodiments, comprise slot (gap) antennas or inverted-F antennas. It should be understood, however, that other types of radiating elements can be isolated using the techniques and structures described herein.

The illustrated slot antennas are formed by two straight, open-ended slots at two opposing edges of a conducting layer etched at one side of a printed circuit board (PCB), to form a pair of quarter wavelength slot antennas. The slots are located along one edge of the PCB opposing each other, and symmetrically with respect to the center line of the PCB. The dimensions of the slots, their shape and their location with respect to the any edge of the PCB can be adjusted to optimize the resonance frequency, bandwidth, impedance matching, directivity, and other antenna performance parameters. Each antenna in this configuration operates with a relatively wide bandwidth. Furthermore the slots, for example, may be tuned to operate at different frequencies using switches at different locations across the length of the slots, for example micro-electromechanical switches (MEMS) or other switch types, so by opening or closing conductive bridges across a slot different resonance lengths are obtained. The other side of the PCB is available for mounting other components of the communication device.

In one embodiment, one or more metal-dielectric isolation structures are formed in the ground plane of the PCB to provide isolation between two antennas, thereby minimizing electromagnetic propagation from one antenna to the other antenna. This is specifically achieved by isolating the currents and inhibiting surface waves that are induced on the ground plane by one antenna from reaching the other antenna. The metal-dielectric isolation structure provides a stop band at given frequency band that impedes propagation of surface waves in the frequency band on the ground plane. Other means for achieving high isolation between antennas, for example a layer of dielectric insulating material covered by a layer of lossy conductive material, can be used.

These metal-dielectric isolation structures are placed a locations between the antennas at locations on the ground plane or the printed circuit board where a high current density exists. Thus the structures are strategically placed only at locations were they are required for isolating the antennas.

When the antennas are such that they can be tuned to different operating frequencies, a mechanism for correspondingly tuning the metal-dielectric isolation structures is also provided.

Examples of specific implementations of the present antenna decoupling technique now will be provided. For simplicity and clarity of illustration, reference numerals may be repeated among the figures to indicate corresponding or analogous elements. In addition, numerous specific details are set forth in order to provide a thorough understanding of the embodiments described herein. The embodiments described herein may be practiced without these specific details. In other instances, well-known methods, procedures and components have not been described in detail so as not to obscure the embodiments described herein. Also, the description is not to be considered as limited to the scope of the embodiments described herein.

Referring initially to FIG. 1, a mobile, wireless communication device 10, such as a cellular telephone, illustratively includes a housing 20 that may be a static housing or a flip or sliding housing as used in many cellular telephones. Nevertheless, other housing configurations also may be used. A battery 23 is carried within the housing 20 for supplying power to the internal components.

The housing 20 contains a main printed circuit board (PCB) 22 on which the primary circuitry 24 for the wireless communication device 10 is mounted. That primary circuitry 24, typically includes a microprocessor, one or more memory devices, along with a display and a keyboard that provide a user interface for controlling the communication device.

An audio input transducer, such as a microphone 25, and an audio output transducer, such as a speaker 26, function as an audio interface to the user and are connected to the primary circuitry 24.

Communication functions are performed through a radio frequency circuit 28 which includes a wireless signal receiver and a wireless signal transmitter that are connected to a MIMO antenna assembly 21. The antenna assembly 21 may be carried within the upper portion of the housing 20 and will be described in greater detail herein.

The mobile wireless, device 10 also may comprise one or more auxiliary input/output (I/O) devices 27, such as for example, a WLAN (e.g., Bluetooth®, IEEE. 802.11) antenna and circuits for WLAN communication capabilities, and/or a satellite positioning system (e.g., GPS, Galileo, etc.) receiver and antenna to provide position locating capabilities, as will be appreciated by those skilled in the art. Other examples of auxiliary I/O devices 27 include a second audio output transducer (e.g., a speaker for speakerphone operation), and a camera lens for providing digital camera capabilities, an electrical device connector (e.g., USB, headphone, secure digital (SD) or memory card, etc.).

Figure 2:
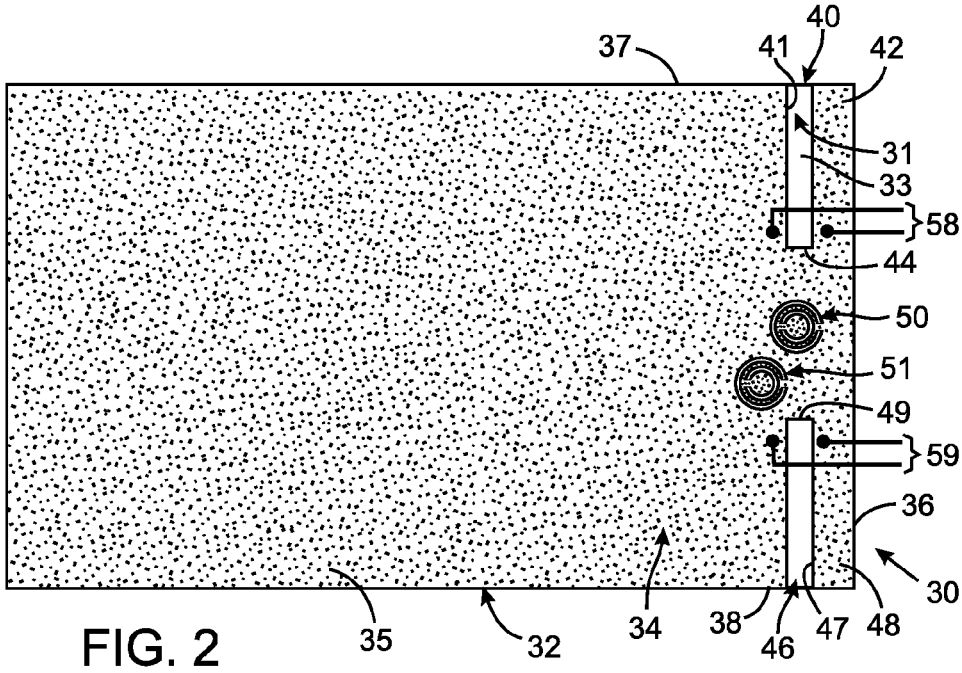
FIG. 2 is a plane view of a printed circuit board on which a first version of a multiple antenna assembly is formed.

FIG. 2 illustrates an exemplary first antenna assembly 30 that can be used as the MIMO antenna assembly 21. The first antenna assembly 30 is formed on a printed circuit board 32 that has a non-conductive substrate 31 of a dielectric material with a first major surface 33 on which a conductive layer 34 is applied to form a ground plane 35. The conductive layer can fully cover the major surface 33 or it can partially cover the surface 33. The substrate 31 and likewise the conductive layer 34 have a first edge 36 and second and third edges 37 and 38 that are orthogonal to the first edge. The printed circuit board 32 may also support the radio frequency circuit 28 and/or a control circuit 29 or it may be a separate printed circuit board connected to the radio frequency circuit. A first antenna 40 comprises a radiating element formed by an open-ended first slot 41 that extends entirely through the thickness of the conductive layer 34. The first slot 41 extends inwardly from the second edge 37 parallel to and spaced at some distance from the first edge 36 and terminates at a closed end 44. A second antenna 46 is similarly formed by an open-ended second slot 47 extending inwardly from the third edge 38 parallel to and spaced from the first edge 36. The first slot terminates at a closed end 49. In this embodiment, the slots of the two antennas 40 and 46 project inwardly from opposing edges 37 and 38 of the ground plane 35 and longitudinally parallel to the common first edge 36 of the ground plane and thus are aligned with respect to each other. The first and second antennas 40 and 46 oppose each other across a width of the ground plane 35 and may have substantially identical shapes. The slot antennas can have other shapes, for example L shape.

The ground plane 35 extends along three sides of the first and second slots 41 and 47. A first conducting strip 42 and a second conducting strip 48 are formed between the first edge 36 and the open-ended slots 41 and 47, respectively. The width of the conducting strips 42 and 48 can be adjusted to optimize the antenna resonant frequency and bandwidth. As a result of this configuration, the first and second slots 41 and 47 form the radiating elements of the first and second antennas 40 and 46, respectively, and are spaced apart by at least one-tenth of a wavelength of a resonant frequency of the second antenna.

A first signal port 58 is provided on opposite sides of the first slot antenna 40 near the closed end 44 for applying a first signal source. A second signal port 59 is provided by other contacts on the ground plane 35 on opposite sides of the second slot 47 near its closed end 49 for applying a second signal source. These signal ports 58 and 59 are connected to the radio frequency circuit 28 of the wireless communication device 10.

Although the present isolation apparatus is being described in the context of an assembly of two antennas, it should be appreciated that the assembly can have a greater number of antennas with additional isolation structures impeding mutual coupling among all the antennas.

A pair of identical metal-dielectric isolation structures 50 and 51 are located on the ground plane 35 between the first and second antennas 40 and 46. Each metal-dielectric isolation structure 50 and 51 is a tuned resonant cell which has a stop band that reduces propagation of radio frequency signals between the first and second antennas 40 and 46. Such a structure may comprise an electromagnetic band gap device, a frequency selective surface, or a metamaterial embedded in the printed circuit board substrate 31.

Each of the metal-dielectric isolation structures 50 and 51 is placed at a location on the ground plane 35 that has a high current density as determined from the emission pattern of the two antennas 40 and 46. Those locations in the ground plane are places in which the current density exceeds a given threshold level. For example, the locations may be where the current density is at least half the maximum current density occurring at any place between the two antennas, and in some instances where the current density is at least seventy percent of that maximum current density level. Note that locating the metal-dielectric isolation structures 50 and 51 based on this criterion does not necessarily form a periodic array, i.e., the spacing between adjacent pairs of the metal-dielectric isolation structures is not identical. It should be understood that the number and location of these metal-dielectric isolation structures 50 and 51 in the drawings is for illustrative purposes and may not denote the actual number and locations for a given antenna assembly design. In some instances, one metal dielectric isolation structure can be used.

The first and second antennas 40 and 46 are designed on the printed circuit board 32 first and their emission patterns determined for the desired radio frequency signals. Based on those emission patterns, the paths in the ground plane 35 and the substrate 31 at which the current density exceeds the threshold level are found. A metal-dielectric isolation structure is then placed in each of those high current density paths.

Figure 5:
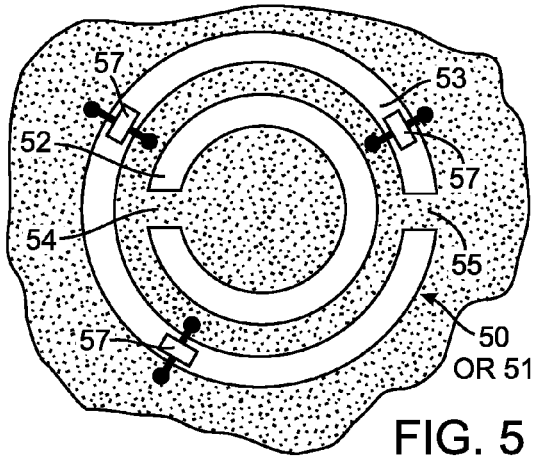
FIG. 5 is a detailed view of one of the metal-dielectric isolation structures in FIG. 2.

As shown in detail in FIG. 5, the metal-dielectric isolation structures 50 and 51 in the embodiment of FIG. 2 comprise two concentric rings 52 and 53 formed by annular slots which extend entirely through the conductive layer 34 that defines the ground plane 35. Each ring 52 and 53 is not a continuous loop, but has a gap in the respective slot which gap is created by a portion of the conductive layer 34. The gap 54 in the slot of the inner ring 52 is oriented 180° from the gap 55 in the slot of the outer ring 53. In other words, the gap 54 is diametrically opposite to the gap 55.

Each of the metal-dielectric isolation structures 50 and 51 can be modeled as an inductor-capacitor network that forms tuned circuit which provides a frequency selective surface that reduces signal propagation between the first and second antennas 40 and 46. The metal-dielectric isolation structures are designed to have a specific frequency stop band that impedes or reflects transmission of those signals. The maximum dimensions of each structure may be about one-tenth of the free space wavelength of the operating frequency of the antenna. If each of the first and second antennas 40 and 46 function at a single frequency, i.e. not be dynamically tunable, then the metal-dielectric isolation structures can have a fixed stop band set to impede the signal coupling between the antennas at the antennas' operating frequencies.

If, however, each of the first and second antennas 40 and 46 operates at one of several different frequencies at different times, then the metal-dielectric isolation structures can be dynamically tunable so that their stop band frequency changes to impede the signal coupling between the antennas at the antenna operating frequency selected at a given point in time. Such dynamic tuning changes the resonant frequency of the metal-dielectric isolation structures.

One way of accomplishing that dynamic tuning is to place one or more elements 57 at selected locations across one or both of the slots of the metal-dielectric isolation structure. In FIG. 5, an embodiment is shown in which the elements 57 are located across the slot of outer ring 52. Each element 57 can be a switch, for example a microelectromechanical switch (MEMS) switch or other switch types, that is controlled by a signal from the control circuit 29. Based on the antenna system operating frequency, the control circuit 29 sends a control signal to one or more of the switches, which opens or closes the switches and changes the stop band of the respective metal-dielectric isolating structure. When closed, the respective switch 57 provides an electrical path the across the slot thereby altering the electrical length of the ring 52 or 53. The elements 57 can also be variable RF tuners having variable inductors and capacitors, which the values are controlled by the controller circuit 29, based on the antenna system operating frequency.

Figure 3:
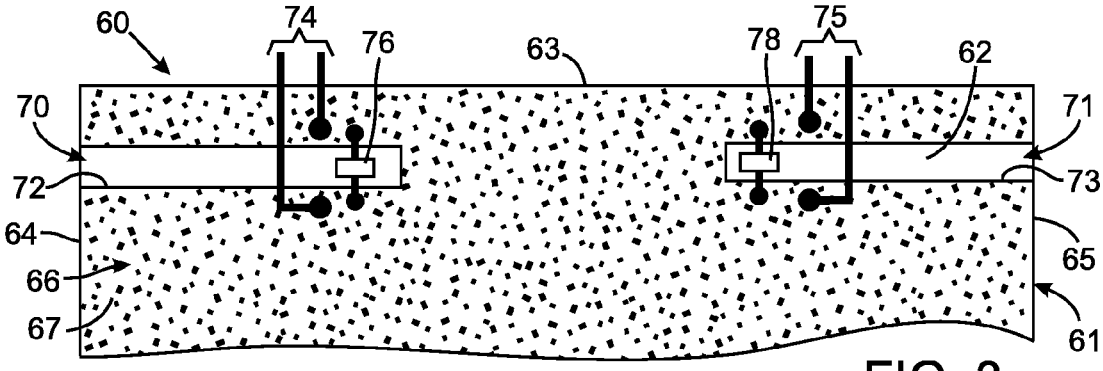
FIG. 3 is an enlarged view a portion of one side of a printed circuit board on which a second version of a multiple antenna assembly is formed.
Figure 4:
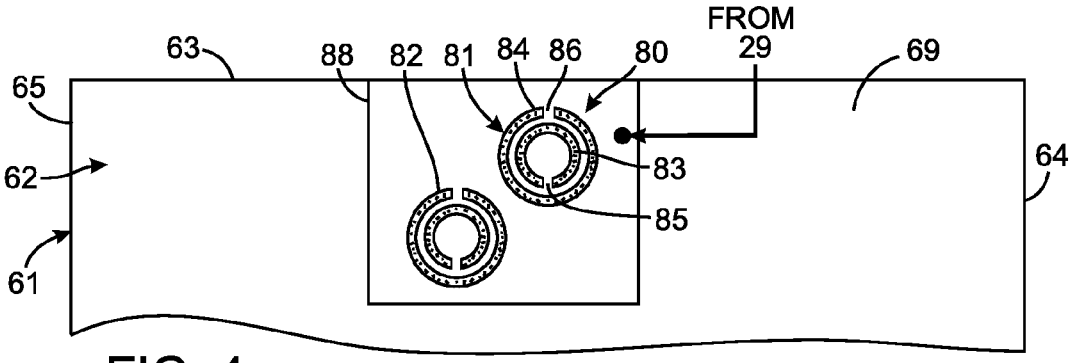
FIG. 4 is an enlarged view of the corresponding portion of the opposite side of the printed circuit board in FIG. 3 showing dynamically tunable metal-dielectric isolation structures.

FIGS. 3 and 4 illustrate a second antenna assembly 60 with a dynamically tunable metal-dielectric isolation arrangement 80. A tunable second antenna assembly 60 is mounted on a printed circuit board 61 that has a non-conductive substrate 62 and three edges 63, 64 and 65. A conductive layer 66 forms a ground plane 67 on a first major surface of the substrate 62. Two antennas 70 and 71, having radiating elements formed by open-ended slots 72 and 73, respectively, that extend in the conductive layer 66 from the opposite edges 64 and 65. The slots have interior closed ends that are spaced apart by a portion of the conductive layer 66. Each antenna 70 and 71 has a separate signal port 74 and 75 to which a radio frequency signal from the radio frequency circuit 28 is applied to excite the respective antenna.

Each antenna 70 and 71 has a shorting device 76 and 78, respectively, which when activated by a signal from the control circuit 29 provides an electrical path across the respective antenna slots 72 or 73. That path changes the effective electrical length of the slot and the frequency to which the antenna is tuned. For example, the shorting devices 76 and 78 may comprise a microelectromechanical switch (MEMS) that is controlled by a signal from the control circuit 29.

The second antenna assembly 60 also differs as having a signal decoupling or isolation arrangement 80, with metal-dielectric isolation structures 81 and 82, which is located on the second major surface 69 of the substrate 62 that is opposite the surface on which the conductive layer 66 is located. In this instance, each metal-dielectric isolation structure 81 and 82 is formed by a pair of concentric rings 83 and 84 a conductive material, such as metal, that is deposited on that opposite surface 69. The inner ring 83 has a gap 85 that is diametrically opposite to a gap 86 in the outer metal ring 84.

The two rings 83 and 84 are formed on a layer 88 of a tunable dielectric material, such as a liquid crystal polymer, that is deposited upon the opposite surface 69 of the printed circuit board substrate 62. In this embodiment, the rings 83 and 84 form the metal portion of the metal-dielectric isolation structure 81 or 82 with the substrate 62 and the liquid crystal polymer layer 88 forming the dielectric component of the structure. Liquid crystal polymers have a dielectric characteristic that changes in response to variation of a DC voltage applied thereto. Therefore, when the radio frequency circuit 28 alters the tuning of the first and second antennas 70 and 71, a signal is sent to the control circuit 29 which applies a DC voltage that biases the liquid crystal polymer layer 88 with respect to the ground plane 67. This biasing alters the dielectric characteristic of the liquid crystal polymer layer 88 and changes the electrical characteristics of the metal-dielectric isolation structure 81 or 82, thereby changing the resonant frequency of that structure to match the radio frequencies that excite the antennas. As illustrated a single liquid crystal polymer layer 88 extends beneath all of the metal-dielectric isolation structures 81 and 82. Alternatively, a separate liquid crystal polymer layer could be placed under each of the metal-dielectric isolation structures.

Although the second antenna assembly 60 is depicted with two metal-dielectric isolation structures 81 and 82, additional dielectric structures can be employed with each one located at a place on the printed circuit board that corresponds to a region of high current density when the two antennas 70 and 71 are emitting signals. Also, a single metal-dielectric structure can be used at the location of highest current density to isolate the antennas.

Figure 6:
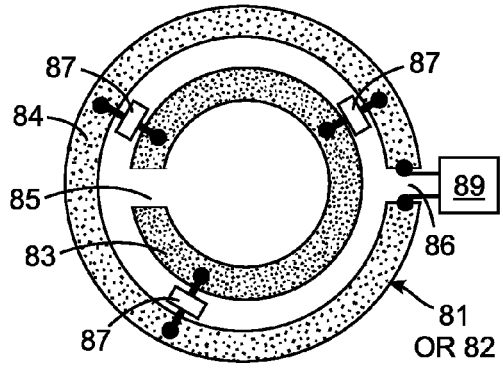
FIG. 6 depicts an alternative technique for dynamically tuning one of the metal-dielectric isolation structures in FIG. 4.

With reference to FIG. 6, other techniques may be employed to dynamically tune the metal-dielectric isolation structures 81 and 82 to resonate at various frequencies. For example, several switches 87 are placed between the two rings 83 and 84 of the metal-dielectric isolation structure at selected radial locations. Each switch 87 may be a microelectromechanical switch, for example, that is controlled by a signal from the control circuit 29. When closed, a respective switch 87 provides an electrical path between the inner and outer rings 83 and 84. A variable tuning circuit 89 can be connected across the gap of one or both of the two rings. The elements of the tuning circuit 89 are changed based on the antenna's operating frequency by a bias voltage from the controller circuit 29. The variable tuning circuit can be used with the switches 87 or individually.

Figure 7:
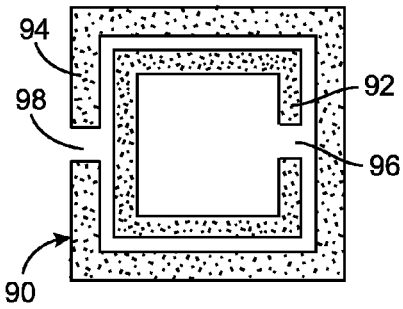
FIG. 7 illustrates a first alternative embodiment of a metal-dielectric isolation structure.

Although the metal-dielectric isolation structures 50, 51, 81 and 82 in FIGS. 2, and 4-6 are implemented utilizing circular ring resonators, other types of resonant cells may be employed. For example as shown in FIG. 7, an alternative metal-dielectric isolation structure 90 has inner and outer rectilinear, e.g. square, rings 94 and 92. If these rings are on the opposite side of the substrate from the ground plane conductive layer, the rings are formed of metal strips, whereas the rings are slots when located on the ground plane conductive layer. Each rectilinear ring 92 and 94 has a gap 96 and 98, respectively, with the gap on one ring being diametrically opposite from the gap on the other ring. Also, in some configurations, a metal-dielectric structure can be formed by one ring, for example comprising one of the rings 52 or 53 of FIG. 5, or alternatively one of the rings 83 or 84 of FIG. 6.

Figure 8:
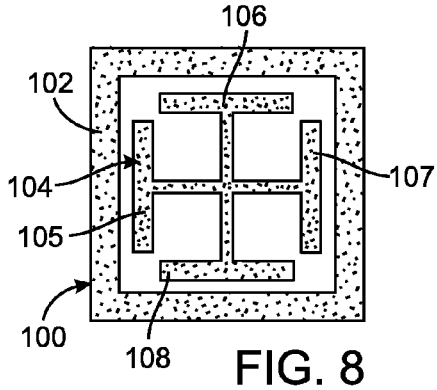
FIG. 8 illustrates a second alternative embodiment of a metal-dielectric isolation structure.

FIG. 8 denotes another configuration of a metal-dielectric isolation structure 100 that can be used as a resonant isolation cell. This structure 100 has a square ring 102 that is continuous and does not have a gap. Within the square ring 102 is an interior element 104 having a shape of a Jerusalem cross. Specifically the interior element has four T-shaped members 105, 106, 107 and 108, each having a cross section extending parallel to and spaced from one side of the square ring 102. Each T-shaped member 105-108 has a tie section that extends from the respective cross section to the center of the square ring 102 at which point all the T-shaped members are electrically connected. Switches can be connected at various locations between the T-shaped members 105, 106, 107 and 108 and the square ring 102 to dynamically tune the resonate frequency of the metal-dielectric structure 100.

Figure 9:
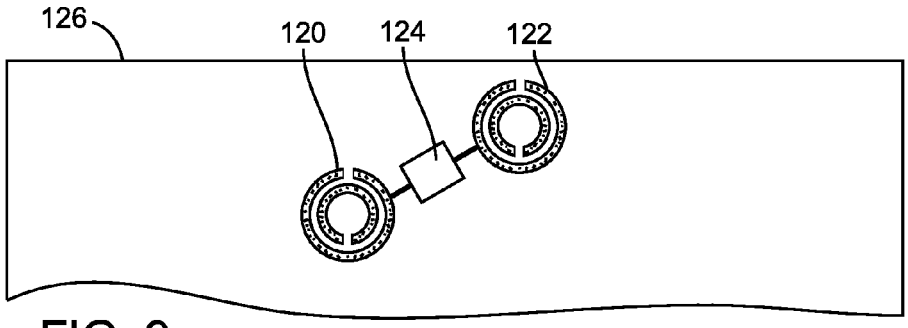
FIG. 9 is an enlarged partial view of one side of a printed circuit board a pair of tunable metal-dielectric isolation structure are formed.

With reference to FIG. 9, a pair of metal-dielectric isolation structures 120 and 122 are located on opposite side of the printed circuit board 126 from the ground plane. An inductive, capacitive (LC) lumped element network 124 is connected between the two metal-dielectric isolation structures 120 and 122. The LC lumped element network 124 has comprises inductors and capacitors that are variable in response to a signal from the controller circuit 29 within the wireless communication device 10. By varying the inductance or capacitance of the lumped element network 124, the resonant frequency of the two metal-dielectric isolation structures 120 and 122 is varied to correspond to the dynamic resonance frequency of the antennas of the wireless communication device 10.

Figure 10:
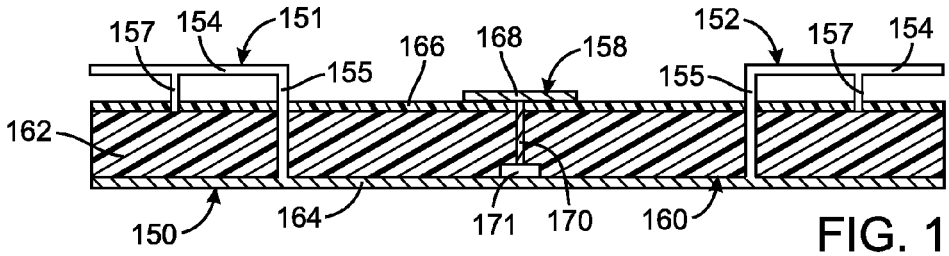
FIG. 10 is a cross sectional view through printed circuit board on which a tunable mushroom type metal-dielectric isolation structure is formed.

FIG. 10 illustrates another embodiment of an antenna assembly 150 that incorporates a further type of metal-dielectric isolation structure 158. This antenna assembly 150 includes first and second inverted F type antennas 151 and 152 mounted on a printed circuit board 160. The printed circuit board 160 comprises a substrate 162 of dielectric material with a first major surface that has a layer 164 of electrically conductive material thereon, thereby forming a ground plane.

The first and second inverted F type antennas 151 and 152 are located on the opposite surface of the substrate 162 from the layer 164 of electrically conductive material. Each antenna has a Radiating element 154 from which a first leg 155 extends through an aperture in the substrate 162 to form a shorting pin that is connected to the electrically conductive layer 164. Another leg 157 extends from the radiating element 154 of each antenna 151 and 152 forming a feed connection to which a radio frequency signal is applied to excite the respective antenna.

A liquid crystal polymer layer 166 covers the surface of the substrate 162 that is opposite to the surface with the electrically conductive layer 164. The metal-dielectric isolation structure 158 may be a "mushroom" type electromagnetic band gap device comprising a patch style metal pattern 168 formed on the liquid crystal polymer layer 166 between the first and second antennas 151 and 152. The metal pattern alternatively may be one of the resonant cells previously described herein or may have other shapes, however in this instance the metal pattern 168 is connected to the electrically conductive layer 164 by a via 170.

The metal-dielectric isolation structure 158 is dynamically tuned to correspond to the frequencies of the signals that excite the first and second inverted F type antennas 151 and 152. That dynamically tuning is accomplished by the control circuit 29 varying a DC voltage applied between the liquid crystal polymer layer 166 and the electrically conductive layer 164. In addition or in the alternative, the via 170 may be connected to the electrically conductive layer 174 by a switch 171, such as a MEMS, for example. Alternatively, the via 170 can be connected to the electrically conductive layer 167 by a lumped RF tuning unit instead of the switch 171. In this configuration, a dc bias voltage is applied to the RF tuning unit from the controller circuit which changes the variable inductive and capacitive elements in the RF tuning unit to tune the metal-dielectric isolation structure 158 to the desired frequency.

It should be appreciated that more than one such metal-dielectric isolation structures 158 can be employed in this antenna assembly, depending upon the locations of high current density regions between the two antennas 151 and 152.

The foregoing description was primarily directed to a certain embodiments of the antenna. Although some attention was given to various alternatives, it is anticipated that one skilled in the art will likely realize additional alternatives that are now apparent from the disclosure of these embodiments. Accordingly, the scope of the coverage should be determined from the following claims and not limited by the above disclosure.

The invention claimed is:

1. An antenna assembly for a wireless communication device comprising:

a substrate of dielectric material and having a first surface and a second surface on opposite sides of the substrate;

a ground plane formed by a layer of electrically conductive material on the first surface;

a first radiating element disposed on the substrate;

a second radiating element disposed on the substrate and spaced apart from the first radiating element; and at least one metal-dielectric isolation structure supported on the substrate between the first and second radiating elements at positions only at which an electric current is present that has a current density greater than a predefined threshold, wherein each metal-dielectric isolation structure resonates at a given frequency that inhibits mutual signal coupling between the first and second radiating elements.

2. The antenna assembly as recited in claim 1 wherein each at least one metal-dielectric isolation structure comprises a pattern of slots in the layer of electrically conductive material.

3. The antenna assembly as recited in claim 1 wherein each at least one metal-dielectric isolation structure comprises a pattern of metal on the second surface of the substrate.

4. The antenna assembly as recited in claim 1 wherein each at least one metal-dielectric isolation structure comprises a pair of concentric rings each having a gap.

5. The antenna assembly as recited in claim 4 wherein the gap of one ring is diametrically opposite to the gap of the other ring and is oriented 180° with respect to the gap of the other ring.

6. The antenna assembly as recited in claim 4 wherein the pair of concentric rings are either circular or rectilinear.

7. The antenna assembly as recited in claim 4 further comprising a switch for selectively creating an electrical path between the pair of concentric rings that alters the given frequency of the at least one metal-dielectric structure.

8. The antenna assembly as recited in claim 1 wherein each at least one metal-dielectric isolation structure comprises a rectilinear ring within which is an element shaped like a Jerusalem cross.

9. The antenna assembly as recited in claim 1 wherein the predefined threshold is half of a maximum current density occurring at any place between the first and second radiating element.

10. The antenna assembly as recited in claim 1 further comprising a device for dynamically varying the given frequency of the at least one metal-dielectric isolation structure.

11. The antenna assembly as recited in claim 10, wherein the device for dynamically varying the given frequency of the at least one metal dielectric structure is a variable tuning circuit comprising a capacitor.

12. The antenna assembly as recited in claim 1, wherein the at least one metal-dielectric structure comprises a switch.

13. The antenna assembly as recited in claim 1 further comprising a layer of liquid crystal polymer on the substrate adjacent to the at least one metal-dielectric isolation structure for dynamically varying the given frequency at which the at least one metal-dielectric isolation structure resonates.

14. The antenna assembly as recited in claim 1 wherein there are a plurality of metal-dielectric isolation structures; and further comprising a separate inductive-capacitive lumped element network between adjacent ones of the plurality of metal-dielectric isolation structures for dynamically varying the given frequency.

15. An antenna assembly for a wireless communication device comprising:

a substrate of dielectric material and having a first surface and a second surface on opposite sides of the substrate;

a ground plane formed by a layer of electrically conductive material on the first surface;

a first radiating element disposed on the substrate;

a second radiating element disposed on the substrate and spaced apart from the first radiating element; and a plurality of metal-dielectric isolation structures forming a non-periodic array on the substrate, wherein each metal-dielectric isolation structure resonates at a given frequency that inhibits mutual signal coupling between the first and second radiating elements.

16. The antenna assembly as recited in claim 15 wherein each of the plurality of metal-dielectric isolation structures on the substrate are at a location where an electric current is present that has a current density greater than a predefined threshold.

17. The antenna assembly as recited in claim 16 wherein the predefined threshold is half of a maximum current density occurring at any place between the first and second radiating elements.

18. The antenna assembly as recited in claim 15 wherein each at least one metal-dielectric isolation structure comprises a pair of either circular or rectilinear concentric rings, each having a gap.

19. The antenna assembly as recited in claim 18 wherein the gap of one ring is diametrically opposite to the gap of the other ring and is oriented 180° with respect to the gap of the other ring.

20. The antenna assembly as recited in claim 18 further comprising a switch for selectively creating an electrical path between the pair of concentric rings that alters the given frequency of the at least one metal-dielectric structure.

21. The antenna assembly as recited in claim 15 wherein each at least one metal-dielectric isolation structure comprises a rectilinear ring within which is an element shaped like a Jerusalem cross.

22. The antenna assembly as recited in claim 15 further comprising a device for varying the given frequency of the at least one metal-dielectric isolation structure.

23. The antenna assembly as recited in claim 15 further comprising a layer of liquid crystal polymer on the substrate adjacent to the at least one metal-dielectric isolation structure for dynamically varying the given frequency at which the at least one metal-dielectric isolation structure resonates.

24. The antenna assembly as recited in claim 15 wherein there are a plurality of metal-dielectric isolation structures; and further comprising a separate inductive-capacitive lumped element network between adjacent ones of the plurality of metal-dielectric isolation structures for dynamically varying the given frequency.

* * * * *